US006733629B1

(12) United States Patent
Matula

(10) Patent No.: US 6,733,629 B1
(45) Date of Patent: May 11, 2004

(54) METHOD OF CONTROLLING THE OPERATION OF AN APPROACH SYSTEM OF A PAPER MACHINE OR THE LIKE WEB FORMATION APPARATUS

(75) Inventor: Jouni Matula, Savonliona (FI)

(73) Assignee: Andritz Oy, Helsinki (FI)

( * ) Notice: Subject to any disclaimer, the term of this patent is extended or adjusted under 35 U.S.C. 154(b) by 2 days.

(21) Appl. No.: 10/049,681

(22) PCT Filed: Aug. 22, 2000

(86) PCT No.: PCT/FI00/00709

§ 371 (c)(1),
(2), (4) Date: Feb. 15, 2002

(87) PCT Pub. No.: WO01/14633

PCT Pub. Date: Mar. 1, 2001

(30) Foreign Application Priority Data

Aug. 23, 1999 (FI) ..... 19991793

(51) Int. Cl.[7] ..... D21F 1/06

(52) U.S. Cl. ..... 162/190; 162/189; 162/253; 162/259; 162/263; 162/264; 162/380; 162/DIG. 11; 700/128

(58) Field of Search ..... 162/189, 190, 162/198, 252, 253, 258, 259, 216, 262–264, 336–340, 380, DIG. 6, DIG. 7, DIG. 10, DIG. 11; 700/127–129; 95/19, 24, 241, 246, 247, 266; 96/156, 157, 174, 193, 200

(56) References Cited

U.S. PATENT DOCUMENTS

| | | | | |
|---|---|---|---|---|
| 2,717,536 A | * | 9/1955 | Clark et al. | 162/380 |
| 3,077,924 A | * | 2/1963 | Eastwood | 162/259 |
| 3,206,917 A | * | 9/1965 | Kaiser et al. | 95/248 |
| 3,703,436 A | * | 11/1972 | Rice | 162/198 |
| 3,779,863 A | * | 12/1973 | Wahren | 162/253 |
| 4,086,130 A | | 4/1978 | Justus | 162/125 |
| 4,219,340 A | | 8/1980 | Kaiser | 95/266 |
| 4,374,703 A | * | 2/1983 | Lebeau et al. | 162/253 |
| 4,378,978 A | * | 4/1983 | Andersson et al. | 95/246 |
| 4,478,615 A | * | 10/1984 | Kaiser | 96/170 |
| 4,956,050 A | | 9/1990 | Makela | 162/216 |

FOREIGN PATENT DOCUMENTS

| | | |
|---|---|---|
| EP | 0 335 343 | 4/1989 |
| FI | 62875 | 10/1983 |
| FI | 79365 | 11/1989 |
| WO | 92/03613 | 5/1992 |

OTHER PUBLICATIONS

Smook, Gary A., Handbook for Pulp and Paper Technologists, Chapter 16, pp. 228–231 (1992).*

* cited by examiner

*Primary Examiner*—Steven P. Griffin
*Assistant Examiner*—Eric Hug
(74) *Attorney, Agent, or Firm*—Nixon & Vanderhye, P.C.

(57) ABSTRACT

The present invention relates to a method and apparatus for controlling the operation of an approach system of a paper machine or the like web formation apparatus. Especially preferably the method of controlling the operation of an approach system according to the invention is applicable to be used in connection with paper and paperboard machines as well as in connection with various apparatuses performing non-woven webformating.

21 Claims, 3 Drawing Sheets

Figure 1:
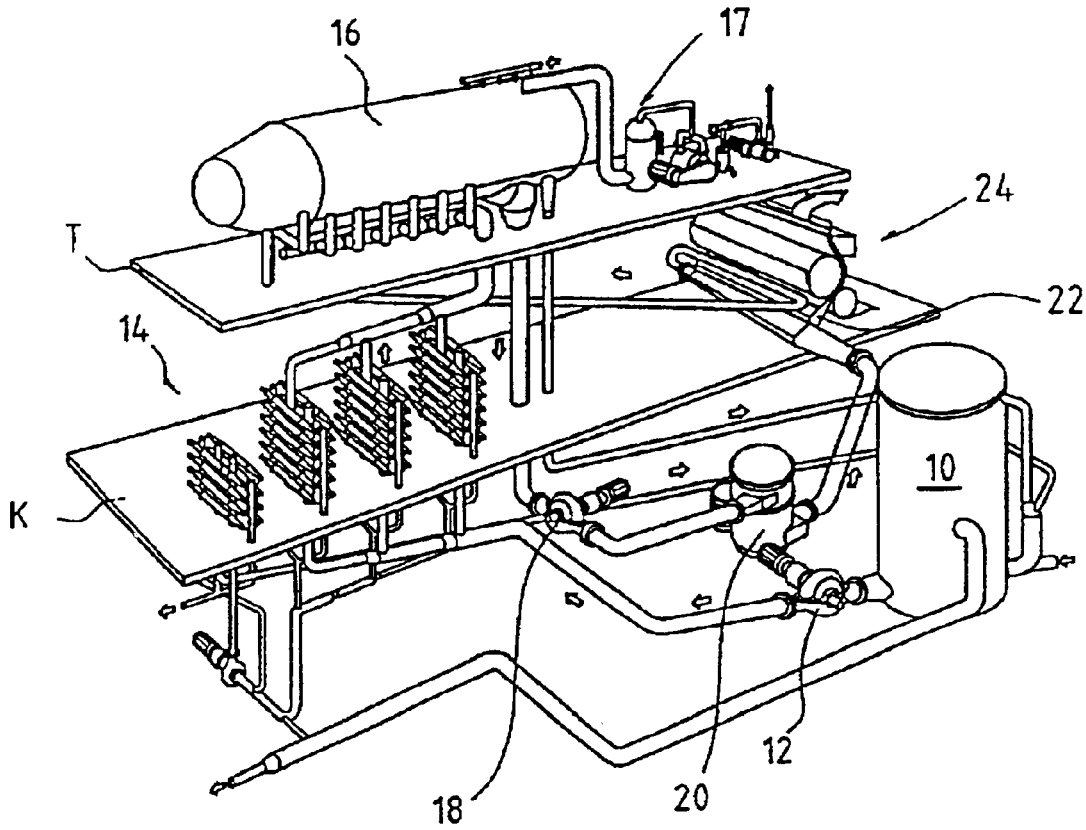

METHOD OF CONTROLLING THE OPERATION OF AN APPROACH SYSTEM OF A PAPER MACHINE OR THE LIKE WEB FORMATION APPARATUS

This application is the U.S. national phase of international application PCT/F100/00709 filed Aug. 22, 2000, which designated the U.S.

The present invention relates to a method of controlling the operation of an approach system of a paper machine or the like web formation apparatus. Especially preferably the method of controlling the operation of an approach system according to the invention is applicable to be used in connection with paper and paperboard machines as well as in connection with various apparatuses performing non-woven webformating.

Almost all prior art paper machine approach systems, which are well described in, e.g. U.S. Pat. No. 4,219,340, comprise the following components: a mixing tank, a feed/mixing pump, a centrifugal cleaning plant, a gas separation tank, a head box feed pump, a head box screen, a paper machine head box and white water trays. Said components are placed in connection with the paper machine and arranged to operate as follows: The fiber material used for paper making and fillers which are diluted with so-called white water obtained from the paper machine, mostly from the wire part thereof, are dosed into the mixing tank often referred to as wire pit and located at the bottom level of the mill. By means of the feed/mixing pump also located at the bottom level of the mill, the fiber suspension is pumped from the mixing tank to the centrifugal cleaning plant located usually at the machine level of the mill, i.e. the location level of the paper machine, or, as in said patent, above it. By means of pressure created by said mixing pump, the fiber suspension accepted by the centrifugal cleaning plant is further conveyed to the gas separation tank located at a level above the machine level. From the gas separation tank the fiber suspension, wherefrom gas has been removed as thoroughly as possible, flows to the head box feed pump located at the bottom revel of the mill, which pump pumps the fiber suspension to the head box screen (not shown in said US patent) also located at the bottom level of the mill, wherefrom the fiber suspension flows to the machine level into the head box of the paper machine.

In order to operate, the gas separation tank described both in said U.S. Pat. No. 4,219,340 and in form of a somewhat newer modification in U.S. Pat. No. 5,308,384 requires a vacuum system most often comprising a vacuum pump, most commonly a so-called liquid ring pump, located at the same level as the gas separation tank, and a drop separator for removing liquid drops possibly present in the gas withdrawn by the vacuum pump. The actual gas separation tank is traditionally a large essentially horizontal tank into which the fiber suspension coming from the centrifugal cleaning plant is sprayed via separate injection pipes. The purpose of the spraying is to give the gas in bubble form a possibility to leave the fiber suspension as early as this stage. In most cases, the gas separation tank is further provided with an intermediate wall, a so-called overflow weir meant for stabilizing the surface level of the fiber suspension in the tank, although there are gas separation tanks with no overflow. The objective of keeping the surface level constant is to ensure a constant inlet pressure for the head box feed pump, at the same time ensuring a constant flow of paper pulp to the head box. In other words, the amount of fiber suspension fed to the gas separation tank via the centrifugal cleaning plant is always somewhat greater than required by the head box. The excess fiber suspension is led via the overflow weir usually to the other end of the gas separation tank, wherefrom a return pipe leads to the mixing tank. Fiber suspension to be pumped to the head box is obtained via a discharge outlet arranged at the bottom of the head box and led to the head box feed pump. Various gas separation tank solutions are disclosed in e.g. U.S. Pat. Nos. 5,236,475, 4,478,615, 4,455,224, 3,538,680, 2,717,536, 2,685,937 and 2,642,950, the three last mentioned of which deal with a gas separation tank without overflow.

U.S. Pat. No. 2,717,536 discusses a gas separation apparatus wherein the fiber suspension flow coming from the centrifugal cleaning plant is led to a gas separation tank having no overflow weir but wherein the surface level is kept constant by means of a surface level transducer and a feed pump flow regulation valve controlled by said transducer. Further said publication presents the location of the gas separation tank at the machine level, i.e. the same level as the paper machine head box.

U.S. Pat. No. 2,685,937 also discloses a gas separation tank with no overflow. In the solution of said patent, there is a float arranged in the gas separation tank, which float follows the changes of the surface level of the fiber suspension. The movements of the float have a direct effect on the fiber suspension flow being fed into the tank, as they regulate the amount of fiber suspension being fed to the tank via the injection pipes.

Said prior art apparatuses have some disadvantages of which e.g. the following problems are worth mentioning.

Firstly, the surface level of the gas separation tank controlled by either an over-flow or various float solutions or other devices directly following the surface level does naturally remain constant, but that does not lead to what the actual purpose of the surface level regulation is, i.e. a constant inlet pressure of the head box feed pump. A reason for this Is that the density of the fiber suspension being pumped together with the surface level determine the inlet pressure. Said density, in turn, is effected by e.g. the filler content and gas content of the fiber suspension. Despite the fact that the filler content of the fiber suspension should be as constant as possible, there are some fluctuations in that. The fluctuations in the density are mostly caused by the gas content of the fiber suspension, which gas content may, in the worst case, vary to the extent of several per cents. Such great changes in the density of the fiber suspension lead to fluctuations in the pulp amount pumped by the head box feed pump, which again is reflected in fluctuations in the thickness of the final product.

In addition to that, prior art apparatuses are not capable of quickly responding to problems caused by e.g. a change in the speed of the machine. According to prior art, attempts were made to solve these problems in a way presented in the block diagram of FIG. 2, which describes a situation where the speed of the paper machine is either increased (the right side of the Figure) or decreased (the left side of the Figure), i.e. the production of the web formation apparatus is changed. In a prior art system, the head box slice flow is naturally changed first, as the production of the machine is controlled by means of it, whether calculated in terms of basis weight of the product or in tons produced by the machine. The starting point is to keep both the head box pressure and the product grammage constant despite changes in the speed of the machine. By means of prior art regulation system this is done so that as the speed of the paper machine increases the slice opening is widened in such a way that a constant pulp amount in proportion to the speed of the wire is continuously flowing from the slice opening (assuming that the head box pressure is constant). When the regulation system senses the widening of the head box slice opening in form of pressure decrease in the head box, the pressure will be increased by increasing the output of the head box feed pump. This in turn results in the lowering of the surface level in the gas separation tank, whereby the regulation system makes the mixing pump feed more pulp into the gas separation tank and the surface level of the tank returns to normal. A regulation arrangement of this type causes various pressure fluctuations in the approach system. Firstly, in order to keep the head box pressure constant as the surface level in the gas separation tank as well as the inlet pressure of the head box feed pump decrease, the capacity of the mixing pump is increased. When the regulation has reached the mixing pump, the mixing pump increases the feed of the gas separation tank, whereby the surface level thereof starts to rise. This causes the head box pressure to increase, which in turn leads to decreasing the capacity of the head box feed pump in order to stabilize the pressure. As the surface level in the gas separation tank has reached its set value, the regulation system guides the mixing pump to decrease the flow, which generates a new pressure effect in the head box. This time the head box pressure leaps downwards, because the head box feed pump has decreased its capacity to correspond to the rising surface of the gas separation tank. As the surface level no more rises, the inlet pressure of the head box feed pump does not rise either. The regulation system handles with this situation by increasing the capacity of the head box feed pump in order to increase the head box pressure to its set value. In practice said development brings forth the danger that the whole production produced during said regulation will turn to broke, as fluctuations in the head box pressure are directly reflected in basis weight fluctuations of the production. In a corresponding way, the consequent effects of decreasing the speed of the paper machine are seen in the left part of FIG. 2.

The basic reason for the problems is that various regulation operations are performed in delay, which means that obvious changes have already taken place either in the head box pressure, the surface level in the gas separation tank or both. In such a case compensating for these calls for changes in the opposite direction, the compensation of which in prior art is further performed in delay, which naturally leads to a situation where reaching the balanced stage takes an unreasonably long time.

Characterizing features of the method of controlling the approach system of a paper machine or the like according to the invention, which solve e.g. said problems, are disclosed in the appended claims.

Figure 3:
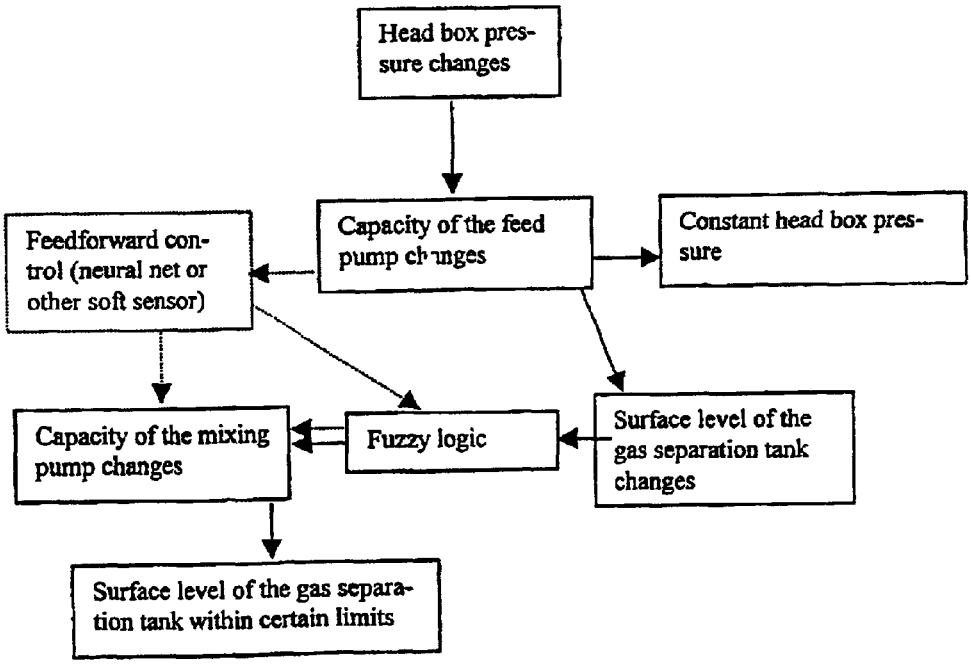
Figure 4:
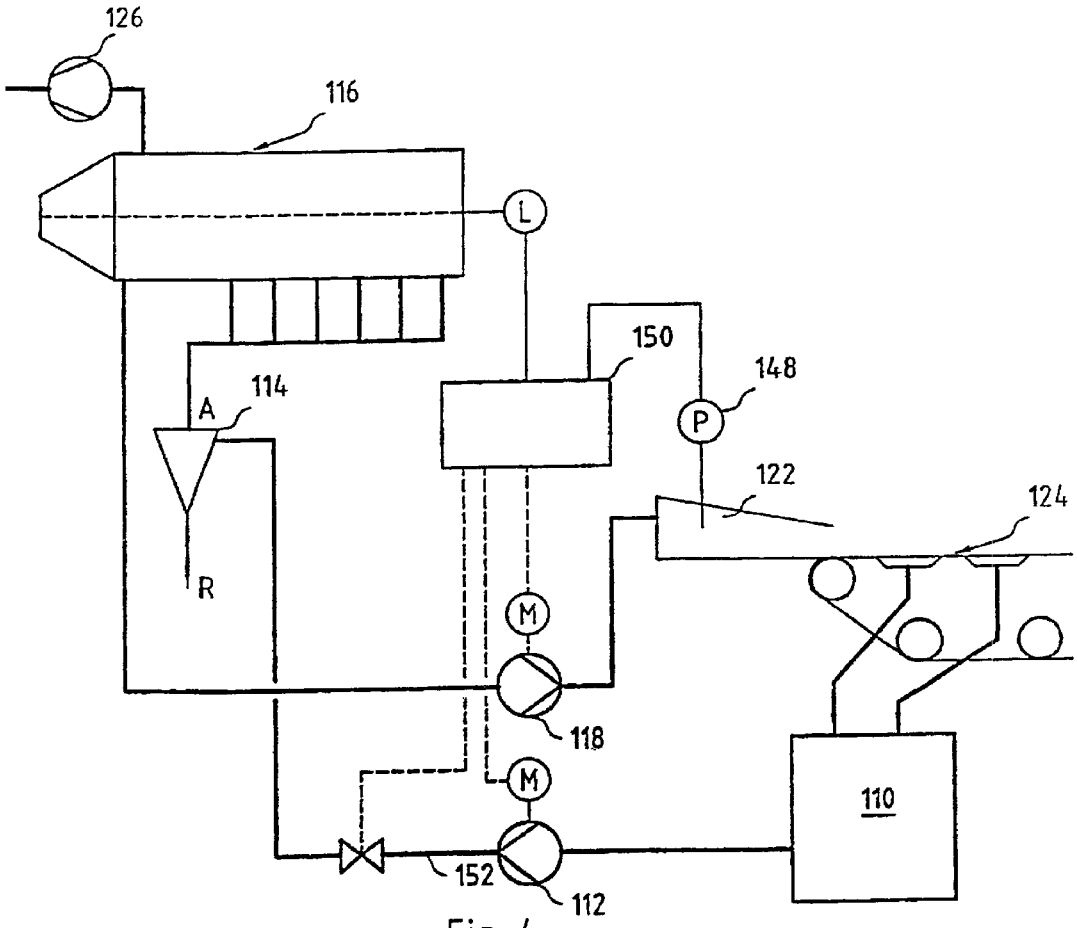

In the following, the method of controlling the operation of the approach system of a paper machine or the like according to the invention are explained in more detail with reference to the appended figures, of which FIG. 1 mainly illustrates a prior art solution disclosed in U.S. Pat. No. 4,219,340, FIG. 2 is a block diagram of a prior art system for regulating the head box pressure, FIG. 3 illustrates in form of a block diagram a regulation system for a paper machine approach system according to a preferred embodiment of the invention, and FIG. 4 illustrates an apparatus arrangement being applied in the embodiment of FIG. 3.

The prior art paper machine approach system illustrated in FIG. 1 comprises a mixing tank/wire pit 10, a feeding/mixing pump 12, a centrifugal cleaning plant 14, a gas separation tank 16, a head box feed pump 18, a head box screen 20, a paper machine head box 22 and white water trays (not shown). Said components are placed in connection with the paper machine 24 and arranged to operate as follows. The fiber material used in papermaking, which may comprise fresh stock, secondary pulp or broke, and so-called fillers, which are diluted with so-called white water obtained from the paper machine, mostly from its wire section, are dosed into the mixing tank 10, which tank may also be a wire pit wherein the white waters are collected and which is located at the bottom level of the mill, to produce paper pulp. By means of a mixing pump 12 also located at the bottom level of the mill said paper pulp is pumped from the mixing tank 10 to a centrifugal cleaning plant 14 usually located at the machine level K of the mill, i.e. at the location level of the paper machine 24. The paper pulp accepted by the centrifugal cleaning plant is further conveyed by means of pressure created by mixing pump 12 into the gas separation tank 16 located at a level T above the machine level. From the gas separation tank 16 the essentially gas-free paper pulp, wherefrom gas has been removed as thoroughly as possible, flows to the head box feed pump 18 located at the bottom level of the mill, which head box feed pump pumps the paper pulp to the headbox screen 20 also located at the bottom level, wherefrom the accepted paper pulp flows to the machine level K into the head box 22 of the paper machine 24.

The operation of the gas separation tank 16 requires a vacuum system 17, most commonly comprising a vacuum pump, in most cases a so-called liquid ring pump located at the same level as the gas separation tank 16, and a drop separator, by means of which drops of liquid possibly present in the gas withdrawn by the vacuum pump and flowing towards the vacuum pump are removed from the gas. The actual gas separation tank 16 is traditionally a large-sized essentially horizontal tank, in to the inner side of which the paper pulp coming from the centrifugal cleaning plant 14 is injected via separate injection pipes. The purpose of the injection is to allow the gas in bubble form a possibility to leave the paper pulp at this stage already. The gas separation tank 16 is further provided with an intermediate wall, a so-called overflow weir, the objective of which is to keep the surface level P of the paper pulp constant in tank 16. This is done in order to ensure a constant inlet pressure for the head box feed pump 18. In other words, the amount of pulp fed from the mixing tank 10 via the centrifugal cleaning plant 14 to the gas separation tank 16 is always to some extent greater than required by the head box 22. The excess paper pulp is led via the overflow weir usually to the other end of the gas separation tank 16, wherefrom a return pipe 34 leads to the mixing tank 10. The paper pulp to be pumped to the head box 22 is obtained via a discharge outlet arranged at the bottom of the gas separation tank 16 and a discharge pipe 36 connected therewith, and lead to the head box feed pump 18.

Figure 2:
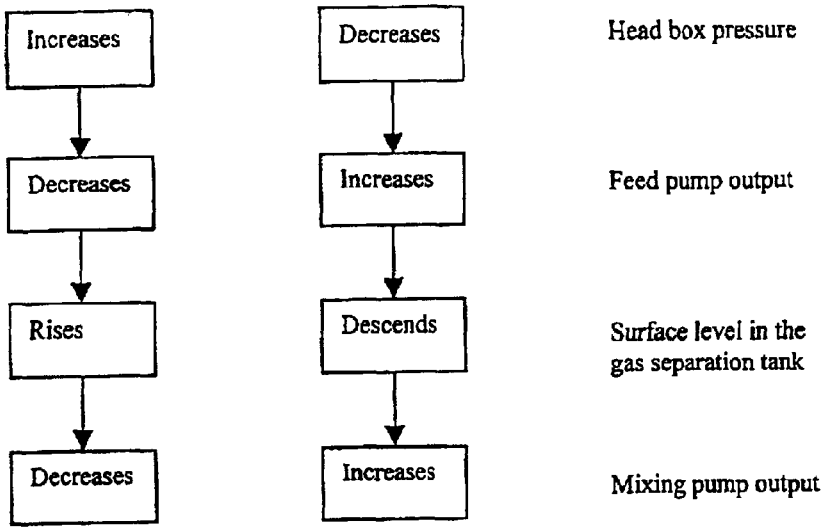

The block diagram of FIG. 2 illustrates a prior art system for keeping the head box pressure constant. The block diagram of FIG. 2 discloses a situation where the speed of the paper machine is decreased (left side of the figure) or increased (right side of the figure). The procedure is exactly the same in any other grade change situation, too. Firstly, when increasing the speed of the paper machine, i.e. increasing the production, it is possible to change the slice flow of the head box 22 either by opening the slice of the head box 22 or by increasing the head box pressure to correspond to the increase of the speed of the paper machine. In most cases increasing the head box pressure compensates for the increase in the speed of the machine. A regulation system of prior art thus requires that the speed of the machine corresponds to a certain head box pressure value, whereby the increased speed of the machine would require higher pressure in the head box compared to earlier value. As a matter of fact, the situation would be just the same, if the head box pressure would start to decrease in a constant running situation. In that case the regulation system naturally guides the feed pump 18 of the head box 22 to increase the head box 22 feed. This in turn results in lowering of the surface level in the gas separation tank 16, whereby the regulation system makes the mixing pump 12 feeding paper pulp to the gas separation tank 16 feed more pulp into the gas separation tank 16 and the surface level of the tank 16 returns to its previous height. This kind of regulation arrangement generates many kinds of pressure fluctuations in the approach system. Firstly, in order to keep the pressure in the head box 22 constant when the surface level in the gas separation tank 16 descends and the inlet pressure of the feed pump 18 of the head box 22 decreases at the same time, the capacity of the feed pump 18 is increased. When the control function of the regulation system has reached the mixing pump 12, the mixing pump 12 increases the feed to the gas separation tank 16, whereby the surface level in the tank 16 starts to rise. As a result, the pressure in the head box 22 increases, which in turn leads to decreasing the capacity of the feed pump 18 of the head box 22 in order to stabilize the pressure. And, when the surface level in the gas separation tank 16 has reached its set value, the regulation system guides the mixing pump 12 to decrease the flow, which generates the following pressure effect on the head box 22. This time the pressure in the head box 22 leaps downwards, as the feed pump 18 of the head box 22 has reduced its capacity to correspond to the rising surface of the gas separation tank 16. The regulation system handles the situation by increasing the capacity of the feed pump 18 of the head box 22 to increase the pressure of the head box 22 to its set value. In practice said development results in driving the whole production obtained during said regulation to broke, as pressure fluctuations of the head box are directly reflected in fluctuations of the grammage of the production.

The block diagram of FIG. 3 illustrates a way to handle the head box pressure regulation and the gas separation tank surface level regulation according to a preferred embodiment of the invention in such a way that disadvantageous pressure fluctuations are avoided. The starting point in the example of FIG. 3, just as in the example of FIG. 2, is a situation where the pressure in the head box changes (in this example the pressure decreases) or it is assumed to change due to either change of grade, change in the speed of the paper machine or to some other reason. The regulation system according to the invention may receive a signal on pressure decrease from several various sources.

One possibility is to utilize information from the pressure transducer of the head box. Another possibility is to monitor the operating point of the head box feed pump. As the pressure in the head box changes, the operating point of the head box feed pump changes, too. To put it differently, although the input power of the pump or the torque does remain constant, the output of the pump changes as the rotational speed changes. Or, if the rotational speed is kept constant, the change in the head box pressure changes the power requirement of the pump.

A decrease in the head box pressure, e.g., directly results in a decrease in the back pressure of the pump, which leads either to an increase in the output of the pump at constant capacity or to a decrease in the input power of the pump at constant rotational speed. Thus a pressure change in the head box reflects in a change in the head box feed pump flow. In other words, at a certain capacity of the pump each output value of the pump corresponds to a certain slice opening of the head box and a certain head box pressure. When the output of the pump changes at said capacity, it indicates that a change has taken place in the head box pressure and/or the slice opening. In that case, as the pressure in the head box decreases, the regulation system increases the capacity of the mixing pump. That is, the mixing pump attempts to keep the gas separation tank surface level constant and the head box feed pump attempts to keep the head box pressure constant. As the effect of the mixing pump reflects on the surface level of the gas separation tank relatively slowly and because the surface level of the gas separation tank in turn reflects on the input pressure of the head box feed pump relatively slowly, delays are necessary between various regulation operations. These delays and set values of various regulation operations are adjusted in the control and regulation system so that the surface level of the gas separation tank and the pressure in the head box remain stable.

In practice the following initial data are needed for practising the method of regulating the head box pressure and controlling the surface level of the gas separation tank according to the regulation system of the present invention.

- The surface level of the gas separation tank, the limit values thereof and the direction of change in the surface level.
- The output i.e. capacity of the headbox feed pump
  - A neural network or some other indirect measuring method based on programmed calculating, i.e. a soft sensor, included in the regulation system determines the output of the pump e.g. from the performance chart of the pump on the basis of the rotational speed of the pump and the pressure difference
- The output i.e. capacity of the mixing pump
  - A neural network or other "soft sensor" included in the regulation system determines the capacity utilizing said initial data
- The head box pressure.

The regulation system handles or utilizes the predetermined data as follows. When the regulation system senses the surface level of the gas separation tank, i.e. the output of the web formation apparatus, to change slowly, it checks whether it is necessary to change the operational mode of the mixing pump and if necessary guides the head box feed pump to compensate for the change of, the inlet pressure, i.e. the output of the web formation apparatus, so that the feed pressure of the head box remains constant. E. g. when the surface level descends, the regulation system smoothly and slowly increases the rotational speed of the head box feed pump, whereby the decreasing inlet pressure caused by the decreasing surface level is compensated for by the slowly increasing output of the head box feed pump, which output increases the head box pressure in the same proportion. If the velocity of the change in the surface level of the gas separation tank is slow enough, the regulation system does not consider it necessary to change the operational mode of the mixing pump and thus does not guide the mixing pump to increase the feed of the gas separation tank, as it is possible that the surface level may return to normal by, itself. Only when the surface level approaches the limit value, the regulation system guides the mixing pump to respond to said change. That is, the regulation system according to the invention allows the surface level of the gas separation tank set freely inside certain maximum and minimum limits.

In some cases it may also be considered necessary that the regulation system guides the mixing pump proactively so that the output of the mixing pump is changed proactively in relation to the change of the feed pump output. This is done in order to take into account the delay, which is caused by the pipeline between the mixing pump and the gas separation tank and the possible centrifugal cleaning plant. In that case, in an optimal situation, the result is that the surface of the head box does not change at all when the slice flow i.e. the output of the web formation apparatus changes.

If there is a need to change the feed of the mixing pump to return the level of the gas separation tank to its set value i.e. approximately in the middle between the limit values, the regulation system, depending on the direction of change in the mixing pump feed, guides the feed pump either to decrease or increase the feed to the head box. If the surface level in the gas separation tank e.g. attempts to decrease below its minimum limit, the regulation system guides the mixing pump to increase the feed to the gas separation tank. At the same time the regulation system is getting ready to decrease, after a certain delay, the output of the head box feed pump i.e. in practice the pressure effect of the feed pump on the head box. The reason for this is that the rising level of the gas separation tank increases the inlet pressure of the feed pump, which in itself already increases the head box pressure.

By means of fuzzy logic applied to the surface level regulation of the gas separation tank the overflow may be omitted from the tank. According to FIG. 3, the surface level regulation may actually be practiced in three ways. The first method is to guide the operational mode of the mixing pump, i.e. the change of the capacity, by means of fuzzy logic and the change in the surface level of the gas separation tank. A second way is to further improve the surface regulation by means of feedforward control, whereby it is possible to determine the flow change from the performance chart of the pump by means of a neural network on the basis of the changed rotational speed and pressure difference of the head box feed pump. This data on the change in the flow from the gas separation tank is transferred via a flow control loop or fuzzy logic directly to the mixing pump, the rotations of which are changed utilizing neural network calculating (the performance chart and the pressure difference data are needed in this) or by means of another "soft sensor". Naturally, other flows entering the gas separation tank have been taken into account. In practice the feedforward control is understood to mean that the capacity of the head box feed pump is determined by means of a neural network and said capacity is required from the mixing pump augmented with possible reject flows which are separated in the process prior to the feed pump. The starting point is, of course, that the portion or amount of said reject flows is known. When various delays in various parts of the process are taken into account in this feedforward, the pump feeds and changes in them may be timed to start in such a way that in practice neither the surface of the gas separation tank nor the head box pressure changes from their set values (the set value may naturally change e.g. in a situation described in the example above).

Thus, fuzzy logic is actually not needed to minimize the head box pressure fluctuations, but mostly to control the surface level of the gas separation tank. A neural network or another "soft sensor" assists fuzzy logic in the feedforward of said regulation.

In a grade change situation, when the production of the machine is changed and the head box pressure may also change remarkably, the regulation system preferably changes the head box pressure stepwise. In that case the regulation system starts to change the output of both the mixing pump and the head box feed pump essentially simultaneously, naturally taking into account said delays.

It may even be thought that the operator of the production machine informs the regulation system on the grammage of the desired final product, after which the regulation system controls the rest of the grade change optimizing the stages needed in that procedure. In practice, the required slice opening and head box pressure for each possible grammage have been fed in the regulation system beforehand. When the regulation system sees how much the slice opening and/or head box pressure has to be changed, it operates according to preset programming, either performing in one single stage both the change of the slice opening and the change of the head box pressure or alternatively changing one or both of these in two or more stages. The regulation system itself functions as already presented above.

Further, the presence or non-presence of the centrifugal cleaning plant in the approach system presents one additional nuance for the operation of the regulation system. If the approach system is devoid of a centrifugal cleaning plant, the regulation system operates as described above. If the approach system is provided with a centrifugal cleaning plant, the regulation system has to be capable of taking it into account in some way. Actually the only thing worth taking into account about an existing centrifugal cleaning plant is its reject flow. In other words, the centrifugal cleaning plant does not let all incoming material to pass into the gas separation tank, but some of the material is led away from the short circulation. There are several ways for taking the centrifugal cleaning plant into account. One way is to always obtain from the centrifugal cleaning plant a constant reject flow despite the flow that enters the plant. In such a case it is easy for the regulation system to subtract from the mixing pump feed the portion that is passed to reject from the centrifugal cleaning plant and use the difference as the initial value for subsequent measures. Another way is to always take a proportionally equal part of the flow to the reject flow. In this case the procedure is in fact the same as already stated except that the true flow amount passing to the gas separation tank is received by multiplying the mixing pump feed by the accept flow ratio of the centrifugal cleaning plant (e.g. 0.97). A third method is to separately determine the reject flow amount, whereby the amount of material going to the gas separation tank is calculated by subtracting the reject flow amount from the mixing pump feed.

FIG. 4 illustrates a solution according to a preferred embodiment of the invention, wherein white waters from the paper machine 124 are led to the white water tank 110, in the bottom part of which fiber suspension and various fillers are combined to form paper pulp. From the white water tank 110, the paper pulp is conveyed by means of mixing pump 112 into the centrifugal cleaning plant 114 and from there further to the gas separation tank 116 and further by means of the head box feed pump 118 to the paper machine head box 122 as known from prior art. What is new in the embodiment of the figure is the surface level control of the gas separation tank 116, which is effected neither by means of prior art overflow nor by means of a system utilizing a float. As the purpose of regulating the surface level of the gas separation tank 116 is to ensure that the pressure of the paper pulp in the paper machine head box remains as exactly constant as possible, the starting point for the surface level control according to the invention is that the level of the paper pulp is allowed to vary within certain limits in the gas separation tank 116 and the regulation of the pressure in the head box 122 is effected by controlling the operation of the pumps 112 and 118. A second new method is a new type of way to ensure a constant pressure in the head box. The pressure in the head box 122 is monitored by a pressure transducer 148, the pressure impulse from which is registered and led to the control unit 150 of the regulation system, which control unit attempts to keep it constant. According to a preferred embodiment of the invention, it is effected primarily so that the feed pump 118 of the head box 122 is controlled on the basis of the impulse from said pressure transducer 148 by means of the control unit 150 of the regulation system. When the pressure impulse indicates a tendency of pressure decrease, the regulation system makes the head box feed pump 118 increase its feed, whereby the pressure in the head box 122 normalizes and the liquid level in the gas separation tank 116 descends. Accordingly, when the pressure increases, the control unit makes the head box feed pump 118 decrease its feed, whereby the pressure in the head box 122 is allowed to decrease and the level in the tank 116 rises. That is, the surface level in the gas separation tank 116 is allowed to vary to some extent.

Depending on the velocity of the change in the gas separation tank 116 surface level, it is also possible to increase or decrease the feed, i.e. in practice the rotational speed, of the mixing pump 112 feeding paper pulp to the gas separation tank 116. In other words, if the surface level of the tank 116 changes very slowly, the central unit only monitors it. Naturally, to a certain limit. And if the surface level descends rapidly, the central unit makes the mixing pump 112 increase the feed, i.e. change its operational mode so as to compensate for the decrease of the gas separation tank 116 surface level. A corresponding regulation measure, i.e. a change of the operational mode of the mixing pump, but in an opposite direction, is naturally performed also when the surface level in the tank 116 rises.

Naturally it is also possible to "teach" the regulation system, primarily the control unit, to more versatile operation, i.e. the speed of change of the pressure impulse from the pressure transducer 148 may be arranged to guide the feed of mixing pump 112, too, and preferably also the rate of change of the feeding speed. Naturally, if it is not desired to control the mixing pump 112 directly, it is possible to arrange a valve 154 in pipe line 152 between the mixing pump 112 and the gas separation tank 116, the operation of which valve is controlled (shown in dash line) also by means of the control unit on the basis of impulses from the pressure transducer 148.

Further, it is possible and in a certain situation also necessary to connect a vacuum system 126 of the gas separation tank 116 to the regulation system i.e. more exactly said to the control unit. This may be utilized e.g. when the stock level in the gas separation tank tends either to descend too low or rise too high. When the level descends too low, measured e.g. by means of a float device or some other corresponding arrangement, the control unit gives a command to increase the vacuum level of tank 116 and at the same time to increase the feed of the mixing pump 112, or alternatively the opening of valve 154, whereby the pressure transducer 148 controls that the inlet pressure of the feed pump 118 of the head box 122 remains constant. As the surface level in the gas separation tank approaches the optimum value, the vacuum level and the feed of the mixing pump 112, alternatively the opening of valve 154, is gradually decreased under control of the pressure transducer 148, until the normal stage has been reached. Further, in a situation where an impulse from a transducer located on the head box 122 or the wire part of the production machine indicates a need to change the feed of the head box 122, it may be performed so that the control unit 150 interprets the incoming control impulse so that it sends a command to first change the feed of the gas separation tank 116 accordingly (by means of the mixing pump 112 and/or the valve 154), whereafter it with a certain delay further sends a command to change the feed of the feed pump 118 of the head box 122. The impulse resulting in this change of the feed of the head box feed pump may be received e.g. from pressure transducer 148.

The pump 112 is preferably a propeller pump, because the feed pressure required from said pump in this application is not very high. Accordingly, the vacuum pump of the gas separation tank 116 is preferably one of the High Speed vacuum pumps produced by Ahlstrom Pumps Corporation, the level of vacuum of which may be regulated by changing the rotational speed of the pump. It is, of course, also possible to use the older water ring pumps, the vacuum level of which may be regulated by means of a valve.

Whether the approach system in question is one provided with a centrifugal cleaning plant, or one in which the centrifugal cleaning is arranged in an earlier stage for each pulp fraction separately,or one without any centrifugal cleaning, it is characterized by the tendency to place the apparatuses at one and the same level, i.e. the machine level, if possible (if allowed by principles of physics). It has to be noted, though, that the head box feed pump usually may not be located at the same level with the gas separation tank, as the underpressure in the gas separation tank is so high that even a minor suction from the direction of the head box feed pump would generate cavitation resulting in the boiling of the water in the tank. For said reason, the head box feed pump has to be taken somewhat lower than the gas separation tank, whereby cavitation and the resulting boiling may be avoided.

As noticed from the above, a new type of paper machine approach system has been developed, which eliminates many prior art weaknesses and disadvantages and solves problems which have been hampering the use of prior art approach systems. Nevertheless, It has to be noted from the above that the individual novelties presented above may be applied separately and not necessarily in the same connection as they have been presented above. Thus it is e.g. possible and wholly in accordance with the invention to totally omit the centrifugal cleaning plant from the embodiment of FIG. 4.

What is claimed is:

1. A method of controlling the operation of an approach system of a web formation apparatus, in which said method comprises:

a. forming a pulp from white water, fiber suspension and fillers, b. feeding said pulp by a mixing pump into a gas separation tank, c. separating gas from said pulp in the tank to produce reduced gas pulp, d. feeding reduced gas pulp to a bead box of the web formation apparatus, and e. changing the feed of the reduced gas pulp to the head box as production changes in the web formation apparatus, and the change in the production of the web formation apparatus initiates a regulation system of the approach system, which regulation system essentially simultaneously checks a need for changing an operational mode of the mixing pump, initiates a change of the operational mode of the mixing pump according to said need, and both guides and regulates a head box feed pump.

2. A method according to claim 1 wherein the regulation system controls both a pressure of the head box and a surface level of the gas separation tank.

3. A method according to claim 1 wherein an operating point of the feed pump and an operating point of the mixing pump are changed essentially simultaneously.

4. A method according to claim 1 wherein a change of head box pressure is readable from a change of an operating point of a head box feed pump, whereby said change of the operating point of head box feed pump initiates a control function of the regulation system.

5. A method according to claim 2 wherein a surface level of the gas separation tank is controlled by a control function of the regulation system initiated by a change of the head box pressure to a control function of the regulation system.

6. A method according to claim 5 wherein the regulation system guides simultaneously the feed pump and the mixing pump so that a pressure in the head box remains constant and a surface level in the gas separation tank remains constant or changes in a controlled manner.

7. A method according to claim 1 wherein the regulation system changes at least an output of the head box feed pump to keep a pressure in the, head box constant, and a surface level variation in the gas separation tank is monitored simultaneously and measurements are taken to control the surface level of pulp in the gas separation tank.

8. A method according to claim 1 wherein a pulp surface level is allowed to change slowly and temporarily in the gas separation tank without changing the feed of the gas separation tank.

9. A method according to claim 1 wherein when a pressure of the head box changes slowly, and the change of the pressure is compensated for by changing a capacity of the head box feed pump, whereby a surface level of the gas separation tank is allowed to change.

10. A method according to claim 1 wherein when a pressure of the head box changes fast, the change of the pressure is compensated for by changing essentially simultaneously a capacity of the head box feed pump and a capacity of the mixing pump.

11. A method as in claim 1 wherein the web formation apparatus is a paper formation machine or a paper board formation machine.

12. A method as in claim 1 wherein said mixing pump is upstream in a flow of the pulp from the gas separation tank, and the head box feed pump is downstream of the tank and upstream of the head box in a flow of the reduced gas pulp.

13. A method as in claim 1 wherein the feed of the reduced gas pulp is a feed rate of the reduced gas pulp.

14. A method of controlling the operation of an approach system of a web formation apparatus, in which said method comprises:

a. forming a pulp from white water, fiber suspension and fillers;

b. feeding said pulp by a mixing pump into a gas separation tank;

c. separating gas from said pulp in the gas separation tank to yield reduced gas pulp;

d. feeding the reduced gas pulp into a head box of the web formation apparatus; and e. changing the feed of the reduced gas pulp to the head box as production changes in the web formation apparatus, wherein the chance in the production of the web formation apparatus initiates a regulation system of the approach system, which regulation system essentially simultaneously checks a need for changing an operational mode of the mixing pump, initiates a change of the operational mode of the mixing pump according to said need, and both guides and regulates a head box feed pump, wherein an operating point of the mixing pump is changed in anticipation of changing an operating point of the feed pump so that a surface level in the gas separation tank located between said pumps remains essentially constant or changes in a controlled manner.

15. A method of controlling the operation of an approach system of a web formation apparatus, in which said method comprises:

a. forming a pulp from white water, fiber suspension and fillers, b. feeding said pulp by a mixing pump into a gas separation tank, c. separating gas from said pulp in the gas separation tank to yield reduced gas pulp, d. feeding the reduced gas pulp into a head box of the web formation apparatus, e. changing the feed of the reduced gas pulp to the head box as production changes in the web formation apparatus, wherein the change in the production of the web formation apparatus initiates a regulation system of the approach system, which regulation system essentially simultaneously checks a need for changing an operational mode of the mixing pump, initiates a change of the operational mode of the mixing pump according to said need, and both guides and regulates a head box feed pump, wherein the regulation system of the approach system controls both a pressure of the head box and a surface level of the gas separation tank, wherein a surface level of the gas separation tank is controlled by arranging a change of the head box pressure to initiate a control function of the regulation system and wherein the regulation system controls the mixing pump anticipatorily in relation to the feed pump so that the head box pressure and the surface level in the gas separation tank remain constant.

16. A method of controlling the operation of an approach system of a web formation apparatus, in which said method comprises:

a. forming a pulp from white water, fiber suspension and fillers, b. feeding said pulp by a mixing pump, into a gas separation tank, c. separating gas from said pulp in the gas separation tank to yield reduced gas pulp, d. feeding the reduced gas pulp into a head box of the web formation apparatus, e. changing the feed of the reduced gas pulp to the head box as production changes in the web formation apparatus, wherein the change in the production of the web formation apparatus initiates a regulation system of the approach system, which regulation system essentially simultaneously checks a need for changing an operational mode of the mixing pump, initiates a change of the operational mode of the mixing pump according to said need, and both guides and regulates a head box feed pump, wherein in a grade change situation, a capacity of the mixing pump and a capacity of the feed pump are changed in a stepwise manner.

17. A method of controlling, the operation of an approach system of a web formation apparatus, in which said method comprises:

a. forming a pulp from white water, fiber suspension and fillers, b. feeding said gulp by a mixing pump into a gas separation tank, c. separating gas from said pulp in the gas separation tank, to yield reduced gas pulp, d. feeding the reduced gas pulp into a head box of the web formation apparatus, e. changing the feed of the reduced gas pulp to the head box as production changes in the web formation apparatus, wherein the change in the production of the web formation apparatus initiates a regulation system of the approach system, which regulation system essentially simultaneously checks a need for changing an operational mode of the mixing pump, initiates a change of the operational mode of the mixing pump according to said need, and both guides and regulates a head box feed pump, wherein the regulation system of the approach system controls both a pressure of the head box and a surface level of the gas separation tank and wherein said surface level regulation is controlled by means of fuzzy logic.

18. A method to provide and regulate pulp flowing through an approach system to a web formation apparatus comprising:

a. forming the pulp from white water, fiber suspension and fillers, b. feeding the pulp by a mixing pump into a gas separation tank, c. separating gas from the pulp in the tank to produce reduced gas pulp, d. feeding reduced gas pulp from the tank, through a head box feed pump and to a head box of the web formation apparatus, e. changing a production operational mode of the head box, and f. in anticipation of the change in the production operational mode, a regulation system for the approach system determines a change to an operational pump mode of the mixing pump and implements the change in the operational pump mode by coordinated adjustments of an operation point of the mixing pump and an operating point of the head box feed pump.

19. A method as in claim 18 wherein the regulation system adjusts a pulp feed output of the head box feed pump to maintain a constant pulp pressure at the head box constant.

20. A method as in claim 18 wherein the regulation system varies a surface level in the gas separation tank by adjusting the operating points of the mixing pump and the head box feed pump.

21. A method as in claim 20 wherein the surface level in the gas separation tank is temporarily changed to without changing a feed rate to the head box.

* * * * *